12/10/85 XB 4,557,854

United States Patent [19]

Plueddemann

[11] Patent Number: 4,557,854

[45] Date of Patent: Dec. 10, 1985

[54] DETERGENT COMPOSITIONS CONTAINING INSOLUBLE PARTICULATES WITH A CATIONIC SURFACE TREATMENT

[75] Inventor: Edwin P. Plueddemann, Midland, Mich.

[73] Assignee: Dow Corning Corporation, Midland, Mich.

[21] Appl. No.: 585,747

[22] Filed: Mar. 2, 1984

[51] Int. Cl.[4] ..... C11D 9/36

[52] U.S. Cl. ..... 252/174.15; 252/99; 252/109; 252/133; 252/135; 252/140; 252/174; 252/179

[58] Field of Search ..... 252/99, 109, 133, 135, 252/140, 174, 179, 174.15

[56] References Cited

U.S. PATENT DOCUMENTS

| | | | |
|---|---|---|---|
| 3,758,408 | 9/1973 | Pallassama et al. | 252/89 |
| 3,899,447 | 8/1975 | McDonald | 252/539 |
| 3,936,537 | 2/1976 | Baskerville, Jr. et al. | 427/242 |
| 4,005,028 | 1/1977 | Heckert et al. | 252/99 |
| 4,051,046 | 9/1977 | Diehl et al. | 252/8.6 |
| 4,062,647 | 12/1977 | Storm et al. | 8/137 |
| 4,178,255 | 12/1979 | Stima et al. | 252/8.8 |

OTHER PUBLICATIONS

N-Trimethoxysilylpropyl-N,N,N-Trimethylammonium Chloride, Silicon Compounds, Petrarch Systems Catalog S-2, p. 43, 1975.

*Primary Examiner*—A. Lionel Clingman
*Assistant Examiner*—Hoa Van Le
*Attorney, Agent, or Firm*—James E. Bittell

[57] ABSTRACT

A novel laundry detergent composition is disclosed comprising an organic surface active agent and an insoluble particulate material having an average particle size from 0.1 to 100 micrometers. The surface of the particulate material is modified by organosilicon compounds containing quaternary ammonium functional organic substituents. The presence of the strongly positive particulate in wash solution improves the cleaning power of conventional organic surface active agents.

8 Claims, No Drawings

DETERGENT COMPOSITIONS CONTAINING INSOLUBLE PARTICULATES WITH A CATIONIC SURFACE TREATMENT

BACKGROUND OF THE INVENTION

This invention relates to laundry detergent compositions which comprise in addition to conventional organic surface active components, a substantially water insoluble particulate material whose surface is modified by treatment with a cationic functional organosilicon compound.

Conventional household laundry detergents are formulated from a number of diverse ingredients designed to function together to provide detersive properties under a variety of water and use conditions. Builders are incorporated into detergents to boost cleaning power especially in hard water. Although phosphates, especially sodium tripolyphosphate perform well as detergent builders, the desirability of reducing for environmental reasons the phosphates in detergent formulations has become apparent. Zeolites have been used as ion exchange agents to replace the sequestering power of the phosphates in detergent formulations, but the formulations often don't provide the cleaning power that is desired.

The present invention is based on the discovery that the cleaning power of conventional organic surface active agents can be boosted by including in the detergent formulation an insoluble particulate material with a surface modified by a cationic organosilicon compound. Detergent compositions containing various particulate materials for specific functions such as scouring, improving processing, imparting fabric softness, controlling electrostatic charge on fabrics and softening wash waters by ion exchange are known in the art. For example, U.S. Pat. No. 4,051,046 describes imparting to fabrics a series of desirable properties including antiwrinkling, ease of ironing, fabric softening, anti-static, folding ease and enhanced fabric drapability by utilizing insoluble particulate materials having a specific anistropic shape.

In U.S. Pat. No. 3,899,447, colloidal silica formed in situ in the detergent composition is said to enhance cleaning and soil removal. In U.S. Pat. No. 4,178,255, relatively large amounts of metakaolin are employed in a laundry detergent composition to provide some fabric softening effect and good detergency. It is also taught that quaternary salt antistatic agents can be included in the detergent compositions containing metakaolin to further improve the fabric softening effect.

Similarly, U.S. Pat. No. 4,062,647 teaches that smectite clay can be incorporated into laundry detergent compositions for fabric softening benefits.

A detergent composition containing particulate titanium dioxide is disclosed in U.S. Pat. No. 3,758,408. The titanium dioxide is said to reduce the yellow discoloration usually associated with the repeated laundering of cotton fabrics with detergents containing sodium carbonate as builder.

U.S. Pat. No. 3,936,537 teaches that antistatic effects can be provided to fabrics in a laundry detergent composition by incorporating quaternary ammonium antistatic compounds into relatively water insoluble organic wax-like materials. The wax particles do not liberate the antistatic compounds until the textile fabrics are subjected to drying at a temperature above 125° F.

Detergent compositions for cleaning solid surfaces are described in U.S. Pat. No. 4,005,028. They contain cationic functional organosilanes that are incorporated to provide soil release benefits to hard surfaces that are washed with the detergent solutions. The organosilanes are deposited from the cleaner solutions onto hard surfaces to provide the soil release property to the surface. An abrasive cleaner was included among the cleaner types described which cleaner contained insoluble particulates such as silica in addition to the organosilane component. There is no suggestion in this patent that the surface of the particulate abrasive is modified by the organosilane or that particulate materials with organosilane modified surfaces could be used in a laundry detergent for textile fabrics.

SUMMARY OF THE INVENTION

The present invention encompasses laundry detergent compositions comprising: (A) from 2 percent to 90 percent by weight of an organic surface active agent and (B) from 10 percent to 98 percent by weight of a particulate material that (a) remains solid and substantially insoluble in water to a temperature of 90° C.; (b) has an average particle size from 0.1 to 100 micrometers; (c) has a cationic surface formed by treating the particulate material with an organosilicon compound represented by the general formula $$O_{(3-n)/2}(OR)_nSiR'N^+R''_3.X^-$$

wherein R is an alkyl radical of 1-3 carbon atoms; R' is a divalent radical that attaches a quaternary nitrogen atom to a silicon atom, contains 3 to 10 carbon atoms, and is attached to the silicon atom at least 3 carbon atoms removed from the quaternary nitrogen atom or any heteroatom in the divalent radical; R'' is a monovalent radical containing 1 to 8 carbon atoms and is independently selected from the group consisting essentially of alkyl radicals, arylalkyl radicals, and substituted alkyl radicals with amino, hydroxyl, or hydrocarbonoxy substituents; X is a halogen or hydroxyl anion; and n has a value from 0 to 3.

In a method aspect, this invention further comprises the laundering of textile fabrics in an aqueous laundry bath containing an effective amount (e.g., from about 0.02% to about 2% by weight) of a laundry detergent composition as described above.

DETAILED DESCRIPTION OF THE INVENTION

The instant invention relates to detergent compositions that are employed in water for laundering soiled textiles. The compositions are commonly described as heavy duty laundry detergents. The invention is based on applicant's discovery that the cleaning power of conventional organic surface active agents can be boosted by combining them with water insoluble particulate material that has its surface modified by a cationic organosilicon compound.

The detergent compositions of this invention employ two essential ingredients; the organic surface active agent; and the solid, insoluble particulate material with the surface modified by a cationic organosilicon compound. Each component is described in detail as follows.

ORGANIC SURFACE-ACTIVE AGENT

From about 2% to about 90% by weight, preferably from about 5% to about 30% by weight of the detergent compositions of this invention comprise a non-soap organic surface active agent. Preferably the organic surface active agent is selected from the group consisting of anionic synthetic surfactant, nonionic synthetic surfactants, ampholytic synthetic surfactants and zwitterionic synthetic surfactants. The total organic surface active agent present can also be a mixture of surfactants such as a mixture containing both anionic and nonionic synthetic surfactants.

The organic surface active agents are well known materials many of which are commercially available and need not be described in great detail here. The various types of synthetic surfactants useful in this invention are described under the designation of synthetic detergents in U.S. Pat. No. 4,062,647 which is hereby incorporated by reference to show the useful anionic, nonionic, ampholytic and zwitterionic synthetic surfactants.

INSOLUBLE PARTICULATE MATERIAL

The second essential component of the detergent compositions of this invention consists of particulate material that boosts the cleaning power of the organic surface active agent. Generally, compositions of this invention contain from about 10% to about 98% by weight of the particulate material based on the combined weight of surface active agent and particulate material. While less than 10% of the particulate material can be employed, such low levels are less favored because of the very minor improvements in cleaning that they provide. The most preferred compositions contain about 50% to about 90% by weight of particulate material based on the combined weights of surface active agent and particulate material.

The composition of the particulate material is not a critical aspect of this invention. It is only necessary that the particulate material remain solid and substantially insoluble in the water during the laundering of clothes. For this purpose, it is preferred that the particulate material remain solid and substantially insoluble in water to a temperature of about 90° C. While materials that dissolve or melt in water at lower temperatures can be used in cool or warm water laundering, they are less preferred because of their more limited utility.

Particulate materials useful in this invention include both organic and inorganic materials. Examples of organic particulate materials that are useful in the detergent compositions of this invention include among others, starch, modified starches, ground rice hulls, nut shell flour, and cellulose. Examples of inorganic particulate materials that are useful in the detergent compositions of this invention include among others, silicon dioxide, diatomaceous earth, fuller's earth, pumice, clay, clay minerals such as kaolinite, vermiculite, montmorillonite and china clay, zeolite, titanium dioxide, talc, glass microbeads, aluminum trihydrate, and aluminates. Other particulate materials such as calcium carbonate and barium sulfate are useful in this invention, but are less preferred because they tend to form less permanently modified surfaces when treated with cationic functional organosilicon compounds.

The grain sizes of the particulate material useful in the detergent compositions of this invention are not critical so long as the particle size is small enough that the material can be readily dispersed in the agitated wash water that the particles does not become adhered to the fabric being laundered. Particulate material with average particle sizes in the range of 0.1 micrometer to 100 micrometers have been found generally to satisfy these requirements and are generally useful in the detergent compositions of this invention. It is even more preferred to employ particulate material with an average particle size of 0.1 micrometer to about 5 micrometers. These particle sizes generally correspond to surface areas of 1 to 25 $m^2/g$. Although diatomaceous silica is generally described as passing through a 325 (maximum particle size 44 micrometers) with an average particle size of about 20 micrometers, it is one of the more preferred particulate materials because the intricate shapes of these residues of plankton skeletons provide a surface area of about 1 to 4 $m^2/g$ which is in the preferred range. Particulate material within this preferred particle size range has been found most effective in boosting the cleaning of organic surface active agents.

The particulate material that is most useful in the detergent compositions of this invention has a surface that is modified by the presence of a cationic functional organosilicon compound. Organosilicon compounds that can be employed to modify the surfaces of particulate materials for this invention are represented by general formula I, $$O_{(3-n)/2}(OR)_nSiR'N^+R''_3.X^-.$$

In Formula I, n has a value from 0 to 3 so that the organosilicon compounds include quaternary nitrogen functional organoalkoxysilanes, partial hydrolyzates of quaternary nitrogen functional organoalkoxysilanes and siloxane oligomers formed by partial condensation of quarternary nitrogen functional organosilanols.

The quaternary nitrogen atom is attached to the silicon in Formula I by R', a divalent radical that contains 3 to 10 carbon atoms. R' is attached to the silicon atom at least 3 carbon atoms removed from the quaternary nitrogen or any other heteroatom in the divalent radical. "Heteroatom" as used here is intended to include any atoms other than carbon and hydrogen. Generally, it is preferred that R' be selected from the group consisting essentially of alkylene radicals, radicals composed of carbon, hydrogen and oxygen, radicals composed of carbon, hydrogen and sulfur, and radicals composed of carbon, hydrogen and nitrogen. For example, oxygen may be present in the R' radical as ether, ester or hydroxyl groups. Similarly, sulfur may be present in the R' radical as thioether, thioester, or thiol groups. Nitrogen, for example, may be present in the R' group as an amine group. Examples of preferred R' radicals include among others, $-CH_2CH_2CH_2-$, $-CH_2CH(CH_3)CH_2-$, $-CH_2CH_2CH_2OCH_2CH(OH)CH_2-$, $-CH_2CH_2CH_2NHCH_2CH_2-$, and $-CH_2CH_2CH_2-S-CH_2CH_2-$.

The R'' groups on the quaternary nitrogen atom of Formula I contain 1 to 8 carbon atoms and may be the same or different. It was found that if the R'' radical contained more than about 8 carbon atoms, a particle surface modified by the organosilicon compound would exhibit undesirable hydrophobic properties. Generally, R'' is selected from the group consisting essentially of alkyl radicals such as methyl, ethyl, and propyl; arylalkyl radicals such as benzyl; and substituted alkyl radicals with amino, hydroxyl or hydrocarbonoxy substituents such as $-CH_2CH_2NH_2$, $-CH_2CH_2OCH_2CH_2OH$, $-CH_2CH_2OH$, and $-CH_2CH_2OCH_2CH_3$.

In Formula I, $X^-$ is a halogen anion such as the anions of chlorine, bromine or iodine or a hydroxyl anion.

The particulate material may be treated with the organosilicon compound to modify the surface by any of the well known methods for applying silanes to the surface of particulate materials. For example, alkoxysilanes may be dropped or sprayed onto agitated particulate material containing surface adsorbed moisture that is sufficient to hydrolyze and form bonds with the silane. Alternatively, the silane can be applied from a solvent solution. Generally, dilute solutions such as 1 to 2 percent silane in water or water miscible organic solvents are preferred. Typically, the particulate material is slurried in a silane-containing solvent. The solvent is then removed by evaporation or filtering and drying to recover the surface modified particulate material.

The detergent compositions of this invention are generally prepared in the well-known, free-flowing granular form. The compositions can be prepared by simply admixing the appropriate ingredients in dry form. Alternatively, the non-volatile components can be slurried in water and then spray dried to provide the familiar detergent granules. Still, another method involves wet mixing of the detergent components with a material that will absorb the water and provide an apparently dry, free-flowing product.

The detergent compositions of this invention can contain other materials commonly used in such compositions. For example, various soil-suspending agents such as carboxymethylcellulose; corrosion inhibitors; tarnish inhibitors, such as benzotriazole or ethylenethiourea; dyes; fillers or bulking agents, such as sodium sulfates, sodium chloride and other neutral alkali metal salts; perfumes; optical brighteners; suds boosters; suds depressants; germicides; pH adjusting agents, such as sodium silicate; enzymes and the like, well-known in the art for use in detergent compositions, can be employed in the compositions herein. Fabric softeners may also be included in the detergent compositions to improve the properties of fabric after washing. The above additional ingredients, when used in the instant compositions, are employed in the usual or conventional concentrations.

The detergent compositions of this invention are generally added to water to provide a laundering liquor containing the instant compositions to the extent of from about 0.02% to about 2% by weight. The effective amount of the detergent composition to be used will depend to an extent on the weight of clothes being laundered and their degree of soiling. Soiled fabrics are added to the laundering liquor and cleaned in the usual manner.

The mechanism by which the surface modified particulate material improves the cleaning power of conventional organic surface active agents is not precisely known. However, it is believed that the strongly positive particulate in the wash solution provides a preferred substrate for adsorption of negatively charged soil loosened by sufactants in the washing process. The particulate and adsorbed soil are then easily flushed out with the wash solution and rinse water.

It should be understood, that applicant does not intend to limit this invention to the proposed mechanism for improved cleaning. It is recognized that other mechanisms may contribute to the improvement or may account entirely for the improvement. An advantage of the instant compositions is that the improved detergency can be achieved with relatively neutral wash solutions that are less hazardous to consumers than the relatively caustic compositions of the prior art. This effect is believed to result from the surface treatment of the particulate which provides bound cationic quaternary ammonium groups which keep the surface strongly positive even at relatively neutral pH.

The following examples are presented to illustrate the invention to those skilled in the art and should not be construed as limiting the invention, which is properly delineated in the appended claims. All proportions by parts or percents are by weight unless otherwise stated.

EXAMPLE 1

This example illustrates the effectiveness of detergent compositions containing diatomaceous earth particles that are treated with various types of quarternary ammonium functional organosilicon compounds to provide a cationic surface on the particles.

Diatomaceous earth (Celite® Filter Aids, Supercel, average particle size 20 micrometers, Johns-Manville, Denver, CO 80217) was slurried in an aqueous (or alcoholic) solution of 1 percent by weight of a quaternary ammonium functional silane based on the diatomaceous earth. The treated particulate material was then separated by filtration and dried for 30 minutes at 100° C. in an air circulating oven. Detergent compositions were prepared by combining 1 part of the sodium salt of dodecylbenzenesulfonic acid (NaDBSA) with 4 parts of the treated particulate material.

Performance of the detergent compositions were evaluated by washing standard soiled fabric swatches (3 to 4 cm square) that were obtained from United States Testing Labs, in Hoboken, N.J., U.S.A. Each washing test included an unfinished polyester/cotton fabric and a permanent press finished polyester/cotton fabric. In addition, swatches of clean, white 100% polyester and 50/50 polyester/cotton were included in each wash so that the extent of dirt redepositon could be determined. The standard soiled fabrics had sufficient soil to reduce reflectometer readings by about 50 units compared with clean, white fabrics. Washing in a good detergent was expected to increase the reflectivity by 5 to 10 units. The standard dirt included oil, grease, carbon black and inorganic particulates.

The washing tests were carried out in 8 oz. jars containing four ceramic balls (12 mm diameter). One of each of the cloth swatches was added to the jar with 100 ml of distilled water, 0.5 g of the detergent composition, enough sodium silicate to give a pH of 9.8 to 10.0 and an appropriate amount of a standard 2:1 $Ca^{++}/Mg^{++}$ solution to give 300 ppm water hardness. The jars were rotated end-over-end at about 60 rpm for 30 minutes during the wash cycle. No temperature control was attempted during the washing, but initial washwater was 75° C.

The performance of the various detergent compositions is shown in Table I. The percent soil removed was determined as the difference in reflectance between the washed fabric and the soiled fabric divided by the difference in reflectance between clean fabric and unwashed, soiled fabric multiplied by 100. The redeposition index was calculated as the reflectance of the clean fabric after being washed with the soiled samples divided by its reflectance before being washed and multiplied by 100. Washing test Nos. 4, 5 and 6 are presented for comparison purposes and are not included in the present invention.

TABLE I

PERFORMANCE OF DETERGENTS CONTAINING DIATOMACEOUS EARTH TREATED WITH CATIONIC SILANES

| CATIONIC FUNCTIONAL GROUP (Y)* | % SOIL REMOVAL UNFINISHED CLOTH | % SOIL REMOVAL PERMANENT PRESS FINISHED CLOTH | REDEPOSITION INDEX UNFINISHED CLOTH |
|---|---|---|---|
| 1. $-\underset{\underset{(CH_3)_2}{\vert}}{N}^+CH_2CH_2OH.Cl^-$ | 16 | 18 | 96 |
| 2. $-NH(CH_2)_3\underset{\underset{(CH_3)_2}{\vert}}{N}^+CH_2C_6H_5.Cl^-$ | 16 | 14 | 97 |
| 3. $-OCH_2\underset{\underset{OH}{\vert}}{C}HCH_2NH(CH_2)_3\underset{\underset{(CH_3)_2}{\vert}}{N}^+CH_2C_6H_5.Cl^-$ | 16 | 12 | 97 |
| 4. $-\underset{\underset{(CH_3)_2}{\vert}}{N}^+CH_2CH_2O\overset{\overset{O}{\Vert}}{C}CH{=}CH_2.Cl^-$ | 12 | 14 | 94 |
| 5. $-\underset{\underset{(CH_3)_2}{\vert}}{N}^+-C_{18}H_{37}.Cl^-$ | 10 | 12 | 95 |
| 6. Control - No Treatment | 10 | 10 | 94 |

*$(CH_3O)_3Si(CH_2)_3-Y$

EXAMPLE 2

This example illustrates the effectiveness of detergent compositions containing various types of insoluble particles treated with $(CH_3O)_3Si(CH_2)_3N^+(CH_3)_2CH_2CH_2OH.Cl^-$ to provide a cationic surface.

Detergent compositions with various particulate materials were prepared and tested for washing efficiency as in Example 1. Both treated and untreated particulate materials were tested to provide a comparison of the effect of the cationic surface on the particles. The washing tests were performed on unfinished 50/50 polyester/cotton with 300 ppm water hardness. The results are presented in Table 2.

Standard soiled fabrics were washed as in Example 1 except that the cationic functional silane, $$(CH_3O)_3Si(CH_2)_3N^+(CH_3)_2CH_2CH_2OH.Cl^-,$$

was added directly to the aqueous wash solution which contained the fiber, 0.1 g of NaDBSA and 0.4 g of untreated diatomaceous earth in 100 ml of 300 ppm hardness water. Reflectance measurements indicated that only 9 percent of the soil had been removed after washing with this mixture. In a similar experiment in which the same particulate material was pretreated with the same cationic functional silane, 14 percent of the soil was removed when the soiled fabrics were washed.

TABLE 2

DETERGENT PERFORMANCE COMPARISON WITH TREATED AND UNTREATED PARTICULATE MATERIALS

| PARTICULATE MATERIAL | PERCENT SOIL REMOVED UNTREATED | PERCENT SOIL REMOVED TREATED | REDEPOSITION INDEX UNTREATED | REDEPOSITION INDEX TREATED |
|---|---|---|---|---|
| Diatomaceous Earth | | | | |
| Supercel[1] | 11 | 14 | 95 | 96 |
| Filtercel[1] | 10 | 14 | 94 | 96 |
| Calcium Montmorillonite | 12 | 14 | 96 | 96 |
| Pumice | 12 | 14 | 94 | 96 |
| Clay[2] | 10 | 10 | 95 | 96 |
| Zeolite | | | | |
| ($Ca^{++}$ hardness only) | 11 | 12 | 95 | 96 |
| ($Mg^{++}$ hardness only) | 9 | 13 | 96 | 96 |
| Starch | 10 | 12 | 93 | 94 |
| Cellulose | 12 | 14 | 95 | 95 |
| Ground Rice Hulls | 12 | 14 | 92 | 93 |

[1]Celite ® Filter Aids, Johns-Manville, Denver, CO, 325 mesh average 20 micrometers
[2]Hydrous kaolin, air-classified about 1.5-2.0 micrometers

EXAMPLE 3

This example illustrates the importance of forming the cationic surface on the insoluble particulate material prior to adding a detergent composition to the aqueous wash solution.

EXAMPLE 4

This example compares the effect of pH on the performance of detergent compositions containing treated and untreated insoluble particulate material. Untreated diatomaceous earth (Supercel) and diatomaceous earth treated as in Example 1 with the cationic functional silane, $(CH_3O)_3Si(CH_2)_3N^+(CH_3)_2CH_2CH_2OH.Cl^-$, were compared in similar detergent mixtures (1 part NaDBSA, 4 parts insoluble particulate) with varying amounts of sodium silicate ($SiO_2/Na_2O$ ratio 3.22) to give the indicated pH when 0.5 g of detergent composition was added to 100 ml of 300 ppm hardness water. The results of washing tests performed by the procedure described in Example 1 are presented in Table 3.

TABLE 3

EFFECT OF pH ON DETERGENT PERFORMANCE

| INSOLUBLE PARTICULATE | pH | % SOIL REMOVED UNTREATED CLOTH | % SOIL REMOVED PERMANENT PRESS | REDEPOSITION INDEX UNTREATED |
|---|---|---|---|---|
| Untreated SUPERCEL | 7.5 | 12 | 12 | 94 |
| Untreated SUPERCEL | 8.5 | 13 | 16 | 95 |
| Untreated SUPERCEL | 9.6 | 11 | 13 | 95.5 |
| Silane Treated SUPERCEL | 7.5 | 13 | 16 | 95.5 |
| Silane Treated SUPERCEL | 8.5 | 13 | 15 | 95.5 |
| Silane Treated SUPERCEL | 9.6 | 11 | 14 | 95 |

EXAMPLE 5

In this example, the performance of detergent compositions of this invention is compared at various water hardnesses and differing concentrations of detergent with the performance of a widely used commercially available laundry detergent.

Detergent composition A was perpared by mixing 20 parts of diatomaceous earth treated as described in Example 1 with 1% of $(C_3O)_3Si(CH_2)_3N^+(CH_3)_2CH_2CH_2OH.Cl^-$, 20 parts of $CaCO_3$, 10 parts of NaDBSA, 2 parts of sodium silicate ($SiO_2/Na_2O$ ratio 3.22) and 90 parts water. The ingredients were mixed to a smooth paste and dried overnight at 65° in an air circulating oven. The resulting dry cake was pulverized to a dry powder. Detergent composition B was prepared in the same manner except that it was prepared from 40 parts of the treated diatomaceous earth, 10 parts NaDBSA, and 2 parts of sodium silicate. Detergent composition C was prepared in the same manner from 20 parts of diatomaceous earth treated with 0.5% of $(CH_3O)_3Si(CH_2)_3N^+(CH_3)_2CH_2CH_2OH.Cl^-$, 20 parts of $CaCO_3$ and 10 parts of Makon 10 (an ethoxylated alkyl phenol that conforms generally to the formula $C_9H_{19}C_6H_4(OCH_2CH_2)_nOH$ where n has an average value of 10) a commercially available nonionic surface active agent marketed by the Stepan Chemical Company, Northfield, Ill. U.S.A. Detergent Composition D was similarly prepared from 40 parts of untreated diatomaceous earth, 10 parts of NaDBSA, 2 parts of sodium silicate ($SiO_2/Na_2O$ ratio 3.22) and 1 part of sodium carboxymethyl cellulose, an antiredeposition agent. In addition to the above detergents, a commercially available heavy duty laundry detergent (Tide containing 6.1% phosphorus) was used in the comparative detergency evaluation.

In eash washing test, 3 pieces of soiled fabric and 3 pieces of clean, white fabric (6 in.×6 in.) were washed in 1 liter of water in a Terg-O-Tometer laboratory-scaled multiple stage washing machine which simulates the action of the agitator type home washing machine. Both permanent press finished and unfinished 50/50 polyester/cotton fabric were tested. Each wash cycle included 15 minutes of agitation at 100 rpm with temperature controlled at 140° F. followed by 2 rinses of 5 minutes each. After the last rinse, the fabric pieces were dried, ironed if necessary and the reflectance determined. The percent soil removed and redeposition index were calculated from the reflectance data as described in Example 1. The results are shown in Table 4 and 5.

TABLE 4

PERCENT SOIL REMOVED

| Detergent | Water Hardness ppm | Unfinished Fabric Detergent Concentration (% by wt) 0.15 | 0.25 | 0.50 | Permanent Press Finish Detergent Concentration (% by wt) 0.15 | 0.25 | 0.50 |
|---|---|---|---|---|---|---|---|
| Tide | 50 | 9.6 | 11.1 | 13.3 | 11.6 | 12.0 | 13.6 |
| Tide | 150 | 7.5 | 10.2 | 12.8 | 9.6 | 11.6 | 13.6 |
| Tide | 300 | 4.6 | 9.3 | 11.4 | 7.6 | 11.6 | 12.0 |
| Composition A | 50 | 10.2 | 15.3 | 18.1 | 12.6 | 14.6 | 17.6 |
| Composition A | 150 | 7.2 | 12.8 | 14.0 | 10.2 | 14.6 | 15.6 |
| Composition A | 300 | 6.7 | 9.6 | 12.3 | 9.1 | 12.2 | 14.0 |
| Composition B | 50 | 15.1 | 16.7 | 18.9 | 11.6 | 15.6 | 17.6 |
| Composition B | 150 | 10.2 | 11.9 | 14.9 | 10.2 | 12.6 | 16.2 |
| Composition B | 300 | 7.2 | 11.9 | 12.8 | 9.0 | 10.6 | 13.0 |
| Composition C | 50 | 11.1 | 14.6 | 18.1 | 14.6 | 15.2 | 19.6 |
| Composition C | 150 | 9.3 | 10.2 | 12.0 | 10.6 | 11.0 | 13.6 |
| Composition C | 300 | 6.3 | 9.8 | 10.7 | 8.0 | 11.2 | 13.0 |
| Composition D | 50 | 18.4 | 18.9 | 19.8 | 19.6 | 20.0 | 21.2 |
| Composition D | 150 | 12.8 | 17.2 | 17.5 | 12.6 | 16.6 | 18.2 |
| Composition D | 300 | 10.5 | 15.8 | 17.9 | 10.2 | 12.6 | 14.6 |

TABLE 5

REDEPOSITION INDEX

| Detergent | Water Hardness ppm | Unfinished Fabric Detergent Concentration (% by wt) 0.15 | 0.25 | 0.50 | Permanent Press Finish Detergent Concentration (% by wt) 0.15 | 0.25 | 0.50 |
|---|---|---|---|---|---|---|---|
| Tide | 50 | 96.1 | 97.5 | 98.4 | 98.6 | 99.4 | 99.5 |
| Tide | 150 | 97.5 | 97.7 | 97.7 | 98.2 | 99.4 | 99.5 |
| Tide | 300 | 96.6 | 96.9 | 97.2 | 98.0 | 98.8 | 99.2 |
| Composition A | 50 | 95.8 | 96.0 | 96.6 | 98.7 | 99.2 | 99.4 |
| Composition A | 150 | 93.9 | 94.3 | 94.9 | 98.0 | 98.2 | 98.6 |
| Composition A | 300 | 93.5 | 94.1 | 94.4 | 96.8 | 97.6 | 98.6 |
| Composition B | 50 | 96.4 | 98.3 | 98.4 | 98.6 | 99.4 | 99.8 |
| Composition B | 150 | 94.5 | 94.9 | 96.9 | 98.0 | 98.8 | 99.2 |
| Composition B | 300 | 93.3 | 94.9 | 95.6 | 97.4 | 97.6 | 98.6 |
| Composition C | 50 | 92.6 | 92.4 | 92.1 | 99.2 | 99.2 | 99.4 |
| Composition C | 150 | 93.2 | 93.8 | 94.4 | 97.6 | 98.0 | 99.2 |
| Composition C | 300 | 91.3 | 91.0 | 92.0 | 96.2 | 97.4 | 98.2 |
| Composition D | 50 | 94.7 | 96.4 | 97.7 | 98.6 | 99.8 | 99.4 |
| Composition D | 150 | 93.9 | 95.0 | 95.5 | 98.2 | 98.6 | 98.8 |
| Composition D | 300 | 92.6 | 93.5 | 94.5 | 98.3 | 98.8 | 98.6 |

EXAMPLE 6

This example illustrates the effectiveness of the detergent compositions of this invention at various pH conditions in the wash water.

Standard soiled fabrics were washed in a Terg-O-Tometer laboratory-scaled multiple stage washing machine to compare soil removal and redeposition index with various buffering additives to control the pH of the wash water. Each washing cycle included 15 minutes of agitation at 150 cycles per minute at 125° F. and two rinses. The wash water contained 200 ppm hardness as 2/1 $Ca^{++}/Mg^{++}$. The fabrics were washed in 1 liter of water containing 0.15 g of Makon 10 and 1.5 g of alumina trihydrate (average particle size 1 micrometer) treated as in Example 1 with 1% of $(CH_3O)_3$-

$Si(CH_2)_3N^+(CH_3)_2CH_2CH_2OH.Cl^-$. The results are shown in Table 6 where the amounts and type of buffering additive employed in each test is indicated along with the initial and final pH of the wash water. It should be noted that the pH decreases during the wash cycle due to removal of acid soil from the fabric.

TABLE 6

EFFECTIVENESS OF DETERGENT COMPOSITIONS AT DIFFERENT pH LEVELS

| Buffering Additive | pH Initial | pH Final | % Soil Removed Wool | Cotton | 50/50 cotton/polyester | 50/50 cotton/polyester permanent press | Redeposition Index polyester | 50/50 cotton/polyester |
|---|---|---|---|---|---|---|---|---|
| 0.02 g Na Silicate[1] | 9.8 | 6.7 | 53 | 34 | 33 | 29 | 98 | 98 |
| 0.04 g Na Silicate[1] | 10.2 | 7.9 | 56 | 34 | 30 | 27 | 100 | 98 |
| 0.06 g Na Silicate[1] | 10.4 | 9.8 | 53 | 34 | 30 | 29 | 102 | 98 |
| 0.09 g Na Silicate[1] | 10.6 | 10.0 | 46 | 31 | 32 | 25 | 100 | 97 |
| 0.20 g $Na_2B_4O_7$ | 7.8 | 7.4 | 60 | 36 | 33 | 32 | 99 | 97 |
| 0.20 g $NaHCO_3$ | 6.9 | 6.9 | 56 | 36 | 35 | 29 | 97 | 97 |

[1]$SiO_2/Na_2O$ ratio 3.22

EXAMPLE 7

This example illustrates the effect of adding the cationic organosilicon compound to a slurry of untreated alumina trihydrate in the wash water before and after the addition of the soiled cloth.

Standard soiled fabrics were washed in the Terg-O-Tometer with 2 g of alumina trihydrate (average particle size 7.0 micrometers) and 0.5 g Makon 10 in 1 liter of water containing 300 ppm hardness as 2/1 $Ca^{++}/Mg^{++}$. The wash cycle consisted of 15 minutes agitation at 150 cycles per minute at 120° F. Preceding the wash cycle, 0.02 g of $(CH_3O)_3Si(CH_2)_3N^+(CH_3)_2CH_2CH_2OH.Cl^+$ was added to the wash water either prior to or after placing the fabric in the wash water. The results are shown in Table 7. Results obtained without any cationic organosilicon are also presented for comparison.

TABLE 7

COMPARISON OF ORGANOSILICON COMPOUND ADDITION METHODS

| Time of organosilicon addition | % Soil Removed wool | cotton | 50/50 cotton polyester | 50/50 cotton polyester permanent press | Redeposition Index polyester |
|---|---|---|---|---|---|
| None (untreated particles) | 47 | 32 | 30 | 27 | 99 |
| Prior to | 44 | 32 | 33 | 29 | 99 |

TABLE 7-continued

COMPARISON OF ORGANOSILICON COMPOUND ADDITION METHODS

| Time of organosilicon addition | % Soil Removed wool | cotton | 50/50 cotton polyester | 50/50 cotton polyester permanent press | Redeposition Index polyester |
|---|---|---|---|---|---|
| After Fabric | 37 | 24 | 30 | 25 | 97 |

EXAMPLE 8

This example presents a comparison of the effectiveness of commercially available detergents and detergent compositions of this invention.

Standard soiled fabrics were washed in a Terg-O-Tometer in 1 liter of water containing 200 ppm hardness as 2:1 $Ca^{++}/Mg^{++}$. The wash cycle consisted of 15 minutes agitation at 150 cycles per minute at 120° F. with two rinses. For commercial detergents, 0.8 g of product was used in each test. Detergents of this invention were composed of 0.15 g of Makon 10, 0.01 to 0.02 g of sodium silicate ($SiO_2/Na_2O$ ratio 3.22) and 0.6 g of one of several types of insoluble particles treated with 1 percent by weight of $(CH_3O)_3Si(CH_2)_3N^+(CH_3)_2CH_2CH_2OH.Cl^-$ as described in Example 1. Composition E contained treated alumina trihydrate with an average particle size of 1 micrometer with 100% of the particles less than 2 micrometers, 85% of less than 1 micrometer and 28% less than 0.5 micrometer. Composition F contained treated alumina trihydrate with an averge particle size of 7 micrometers. Composition G contained treated diatomaceous earth with an average particle size of 20 micrometers. The results are shown in Table 8.

TABLE 8

COMPARISON WITH COMMERCIALLY AVAILABLE DETERGENTS

| Detergent | Final pH of wash water | % Soil Removed wool | cotton | 50/50 cotton polyester | 50/50 cotton polyester permanent press | Redeposition Index polyester | 50/50 cotton polyester |
|---|---|---|---|---|---|---|---|
| Amway ®[1] | 11.2 | 40 | 30 | 29 | 24 | 100 | 100 |
| Tide ®[2] | 10.3 | 49 | 25 | 32 | 25 | 99 | 97 |
| Dash ®[2] | 10.4 | 51 | 22 | 23 | 18 | 97 | 95 |
| Cold Water Surf ®[3] | 9.4 | 57 | 24 | 28 | 24 | 97 | 98 |
| Dreft ®[2] | 9.6 | 55 | 25 | 26 | 18 | 97 | 97 |
| Composition E | 10.2 | 54 | 31 | 30 | 29 | 99 | 97 |
| Composition F | 8.1 | 49 | 34 | 30 | 29 | 99 | 93 |
| Composition G | 8.2 | 44 | 34 | 35 | 29 | 100 | 95 |

[1]Amway Corporation, Ada, MI 49355
[2]Procter & Gamble Company, Cincinnati, OH 45201
[3]Lever Brothers Company, New York, NY 10022

Fabric

That which is claimed is:

1. A laundry detergent composition comprising (A) from 2 percent to 90 percent by weight of an organic surface active agent and (B) from 10 percent to 98 percent by weight of a particulate material that (a) remains solid and substantially insoluble in water to a temperature of 90° C.;

(b) has an average particle size from 0.1 to 100 micrometers;

(c) has a surface modified by an organosilicon compound represented by the general formula $$O_{(3-n)/2}(RO)_nSiR'N^+R_3''.X^-$$

wherein R is an alkyl radical of 1 to 3 carbon atoms; R′ is a divalent radical that attaches a quaternary nitrogen atom to a silicon atom, contains 3 to 10 carbon atoms, is selected from the group consisting essentially of alkylene radicals, radicals composed of carbon, hydrogen and oxygen, radicals composed of carbon, hydrogen and sulfur, and radicals composed of carbon, hydrogen and nitrogen, and is attached to the silicon atom at least 3 carbon atoms removed from the quaternary nitrogen atom or any oxygen, sulfur or nitrogen atom in the divalent radical; R″ is a monovalent radical containing 1 to 8 carbon atoms and is independently selected from the group consisting essentially of alkyl radicals, arylalkyl radicals, and substituted alkyl radicals with amino, hydroxyl, or hydrocarbonoxy substituents; X is a halogen or hydroxyl anion; and n has a value from 0 to 3.

2. The laundry detergent composition of claim 1 wherein the particulate material is selected from the group consisting essentially of silicon dioxide, diatomaceous earth, fuller's earth, pumice, clay, clay minerals, zeolite, titanium dioxide, talc, glass microbeads, aluminum trihydrate, aluminates, starch, ground rice hulls, nut shell flour, and cellulose.

3. The laundry detergent composition of claim 2 wherein the organic surface active agent is selected from the group consisting of anionic synthetic surfactants, nonionic synthetic surfactants, ampholytic synthetic surfactants and zwitterionic synthetic surfactants.

4. The laundry detergent composition of claim 3 wherein the composition contains 50 percent to 90 percent by weight of the particulate material based on the combined weight of surface active agent and particulate material.

5. The laundry detergent compositions of claim 4 wherein the particulate material has an average particle size from 0.1 to 5 micrometers.

6. The laundry detergent compositions of claim 5 wherein n is 3 and R′ is an alkylene radical.

7. The laundry detergent composition of claim 6 wherein the organosilicon compound is $$(CH_3O)_3Si(CH_2)_3\underset{\underset{(CH_3)_2}{|}}{N}^+CH_2CH_2OH.Cl^-.$$

8. A process for laundering textile fabrics comprising contacting a textile fabric with an aqueous laundry bath containing an effective amount of a composition comprising (A) from 2 percent to 90 percent by weight of an organic surface active agent and (B) from 10 percent to 98 percent by weight of a particulate material that (a) remains solid and substantially insoluble in water to a temperature of 90° C.;

(b) has an average particle size from 0.1 to 100 micrometers;

(c) has a surface modified by an organosilicon compound represented by the general formula $$O_{(3-n)/2}(RO)_nSiR'N^+R_3''.X^-$$

wherein R is an alkyl radical of 1 to 3 carbon atoms; R′ is a divalent radical that attaches a quaternary nitrogen atom to a silicon atom, contains 3 to 10 carbon atoms, is selected from the group consisting essentially of alkylene radicals, radicals composed of carbon, hydrogen and oxygen, radicals composed of carbon, hydrogen and sulfur, and radicals composed of carbon, hydrogen and nitrogen, and is attached to the silicon atom at least 3 carbon atoms removed from the quaternary nitrogen atom or any oxygen, sulfur or nitrogen atom in the divalent radical; R″ is a monovalent radical containing 1 to 8 carbon atoms and is independently selected from the group consisting essentially of alkyl radicals, arylalkyl radicals, and substituted alkyl radicals with amino, hydroxyl, or hydrocarbonoxy substituents; X is a halogen or hydroxyl anion; and n has a value from 0 to 3.

* * * * *

UNITED STATES PATENT AND TRADEMARK OFFICE

CERTIFICATE OF CORRECTION

PATENT NO. : 4,557,854

DATED : December 10, 1985

INVENTOR(S) : Edwin P. Plueddemann

It is certified that error appears in the above-identified patent and that said Letters Patent is hereby corrected as shown below:

In Col. 1, lines 42-43, delete "anistropic" and substitute therefor --anisotropic--.

In Col. 4, line 13, insert the word "mesh" before "(maximum".

In Col. 6, line 39, delete "redepositon" and substitute therefor --redeposition--.

In Col. 9, line 62, delete "eash" and substitute therefor --each--.

In Col. 11, line 34, delete "$Si(CH_2)_3N^+(CH_3)_2CH_2CH_2OH.Cl^+$" and substitute therefor --$Si(CH_2)_3N^+(CH_3)_2CH_2CH_2OH.Cl^-$--.

In Col. 11, line 50, insert the word "Fabric" after "to".

In Col. 12, line 32, delete "Mg++" and substitute therefor --$Mg^{++}$--.

Signed and Sealed this

Second Day of September 1986

[SEAL]

Attest:

DONALD J. QUIGG

Attesting Officer

Commissioner of Patents and Trademarks